United States Patent [19]

Morris et al.

[11] Patent Number: 4,604,171

[45] Date of Patent: Aug. 5, 1986

[54] UNITARY CENTRAL CELL ELEMENT FOR FILTER PRESS, SOLID POLYMER ELECTROLYTE ELECTROLYSIS CELL STRUCTURE AND PROCESS USING SAID STRUCTURE

[75] Inventors: Gregory J. E. Morris, Lake Jackson; John R. Pimlott, Sweeny; Richard N. Beaver, Angleton; Hiep D. Dang, Lake Jackson; Sandor Grosshandler, Houston, all of Tex.

[73] Assignee: The Dow Chemical Company, Midland, Mich.

[21] Appl. No.: 774,255

[22] Filed: Sep. 9, 1985

Related U.S. Application Data

[63] Continuation of Ser. No. 682,738, Dec. 17, 1984, abandoned.

[51] Int. Cl.[4] ..... C25B 1/46; C25B 13/02

[52] U.S. Cl. ..... 204/98; 204/128; 204/254; 204/268; 204/279; 204/283

[58] Field of Search ..... 204/98, 128, 254, 268, 204/279, 282, 283, 289, 297 R

[56] References Cited

U.S. PATENT DOCUMENTS

| | | | |
|---|---|---|---|
| 3,752,757 | 8/1973 | Stephenson, III et al. | 204/256 |
| 3,788,966 | 1/1974 | Stephenson, III et al. | 204/256 |
| 3,859,197 | 1/1975 | Bouy et al. | 204/284 |
| 3,884,781 | 5/1975 | Bouy et al. | 204/98 |
| 3,960,698 | 6/1976 | Bortak | 204/267 |
| 3,960,699 | 6/1976 | Bortak et al. | 204/268 |
| 4,017,375 | 4/1977 | Pohto | 204/255 |
| 4,111,779 | 9/1978 | Seko et al. | 204/255 |
| 4,115,236 | 9/1978 | Smura | 204/254 |
| 4,137,144 | 1/1979 | Kenney | 204/268 |
| 4,194,670 | 3/1980 | Ichisaka et al. | 228/179 |
| 4,247,376 | 1/1981 | Dempsey et al. | 204/128 |
| 4,294,671 | 10/1981 | Balko | 204/128 |
| 4,340,452 | 7/1982 | deNora | 204/129 |
| 4,364,815 | 12/1982 | Darlington et al. | 204/283 |
| 4,389,289 | 6/1983 | deNora | 204/268 |
| 4,444,632 | 4/1984 | deNora | 204/98 |
| 4,444,641 | 4/1984 | Oda et al. | 204/286 |
| 4,457,815 | 7/1984 | Levin | 204/98 |
| 4,457,823 | 7/1984 | LaConti et al. | 204/282 |
| 4,488,946 | 12/1984 | Morris et al. | 204/98 |

OTHER PUBLICATIONS

Mitchell, D. R. and Kessler, H. D., "The Welding of Titanium to Steel", *Welding Journal*, Dec. 1961.

*Primary Examiner*—John F. Niebling
*Assistant Examiner*—Terryence Chapman
*Attorney, Agent, or Firm*—James H. Dickerson

[57] ABSTRACT

Unitary, cast structural element for solid polymer electrolyte filter pass electrolysis cell which incorporates into a single unit the central barrier between the peripheral boundaries for the adjacent anode compartment and adjacent cathode compartment of two electrolysis cells located on opposite sides of the central barrier. Also incorporated into the single cast structural element are anode bosses and cathode bosses extending outwardly from opposite sides of the central barrier. These bosses not only serve as mechanical support for their respective flat plate anode and cathode, but also they serve as stand-off means and electrical current collectors and dispersers from the cathode of one electrolysis cell to the anode of the next cell. Simplicity of design coupled with incorporation of many functional elements into one part eliminates many cell warpage problems, inherent high voltage problems and solid polymer electrolyte membrane "hot spot" problems.

50 Claims, 3 Drawing Figures

UNITARY CENTRAL CELL ELEMENT FOR FILTER PRESS, SOLID POLYMER ELECTROLYTE ELECTROLYSIS CELL STRUCTURE AND PROCESS USING SAID STRUCTURE

CROSS-REFERENCE TO RELATED APPLICATION

This is a continuation, of application Ser. No. 682,738, filed Dec. 17, 1984 now abandoned.

BACKGROUND OF THE INVENTION

This invention relates to an improvement in the structure of bipolar electrode-type, filter press solid polymer electrolyte electrolysis cells. More particularly it relates to those of such cells which employ permselective ion exchange membranes having an electrocatalytic material bonded to or embedded in the membrane and acting as anodes or cathodes. Such cells are particularly useful in the electrolysis of aqueous solutions of alkali metal chlorides; especially in the electrolysis of aqueous solutions of sodium chloride (sodium chloride brine). The cell structure may also be used in electrolyzing other solutions to make products such as potassium hydroxide, iodine, bromine, bromic acid, persulfuric acid, chloric acid, adiponitrile and other organic compounds made by electrolysis.

The unitary filter press central cell element used in the present invention decreases the cost of manufacture of the cell units, decreases the labor required to assemble them, simplifies their manufacture, greatly reduces the warpage of the cell unit parts, and provides a much sturdier cell structure than do bipolar, filter press cells of the prior art.

Reducing the warpage of cell structure allows the cell to be operated more efficiently; i.e., produce more units of electrolysis products per unit of electricity. Reducing the warpage reduces the deviation from design of the gap width between the current collectors and/or anode and cathode of each electrolysis cell. Ideally this gap width is uniformly the same between the current collectors and/or anode and cathode in order to have a uniform current density spread between the faces of the cell electrodes. Among other things, structural warpage causes deviation of this gap resulting in some parts of the current collector and/or anode and cathode being closer together than others. At these locations, the electrical resistance is less, the electrical current is more, and thus the electrical heating is greater. This electrical heating is sufficient in many instances to cause damage to the membrane at these locations. These locations of unacceptably high electrical current concentration and high heat are referred to herein as "hot spots".

To avoid these hot spots, the prior art has had to design its cell structures with a greater than desired gap width between the current collectors and/or anode and cathode of each electrolysis cell. This, of course, increases the cell operating voltage and decreases the cell operating efficiency. Complexity of design and fabrication is another drawback of those cells.

Except for the structures used fdr the terminal cells of a bipolar filter press cell series, the structures for the intermediate cells in the series are like, repetitious, cell structural units which are squeezed together. Examples of such cells operated in a cell series are disclosed in Seko, U.S. Pat. Nos. 4,111,779 (Sept. 5, 1978) and in Pohto, 4,017,375 (Apr. 12, 1977). These patents are herein incorporated by reference for purposes of showing representative prior art and for showing how bipolar filter press cells are formed into and operated in a cell series.

At this point, a clarification should be made about confusing nomenclature sometimes encountered when speaking of a series of bipolar filter press cells. The problem involves the nomenclature often encountered when dealing with the repeating electrolysis cells and the repeating cell structure units used to house these repeating electrolysis cells. In the electrolysis cells there is a membrane planarly disposed in or about the center of each electrolysis cell between a parallel anode and cathode. The membrane divides the electrolysis cell itself into an anode and cathode compartment. However, in appearance in a cell series the membrane often appears to be the division line between repeating cell units. In fact, it often is located at the division between repeating cell structures in the series, but not at the line separating different electrolysis cells. This comes about because the repeating cell structures are situated between and around parts of adjacent, but different, electrolysis cells. Such a repeating cell structure includes structure which defines the periphery of the cathode compartment of one of two adjacent electrolysis cells. This repeating cell structure includes structure which defines the periphery of the anode compartment of the other of the two adjacent electrolysis cells and the barrier structure separating the two electrolysis cells. So the anode compartment and the cathode compartment associated with a given repeating structural unit are compartments of adjacent, but different, electrolysis cells.

These repeating cell structures include several other structural elements which will be discussed below. Herein this repeating structural unit will be referred to as a "bipolar electrode-type, filter press-type solid polymer electrolyte electrolytic cell unit". As used with the present invention, this cell unit is referenced in the drawing by reference number 10.

There are other structural elements included in a bipolar electrode-type, filter press-type electrolytic cell unit besides the electrolyte compartments peripheral structure and the electrolyte impervious central barrier. These include an anode, a cathode, an anode stand-off means, a cathode stand-off means, and an electrical current transfer means.

The central barrier separates the anode compartment of one adjacent electrolysis cell from the cathode compartment of the other adjacent electrolysis cell.

The anode and cathode are spaced from and spaced on opposite sides of the central barrier by the anode and cathode stand-off means, respectively. This spacing is provided so as to provide room for the electrolyte and electrolysis products to circulate in the space between the electrodes and their central barriers.

The anode stand-off means and cathode stand-off means most often also serve as the electrical current means used to electrically connect the anode on one side of the barrier with the cathode on the opposite side of the barrier. This connection is made through the barrier.

The anode and cathode are usually of the "flat plate" type. That is, they present a planarly disposed working surface, or assembly of surfaces, to their respective membranes. They are most often parallelly disposed to their respective membranes, to the axis plane of the central barrier, and to each other. Also the anode and cathode are usually made of a foraminous metal.

The anode compartment is defined by the space between the central barrier and the membrane disposed on the anode side of the central barrier as well as the structure fitted around and between the periphery of this membrane and central barrier. Note, the anode is disposed within the anode compartment by definition. Likewise the cathode compartment is defined as the space between the central barrier and the membrane on the cathode side of the central barrier and by the peripheral structure fitted around and between the periphery of the central barrier and the membrane on the cathode side of the central barrier. Again the cathode is in the cathode compartment by definition.

The anode and cathode of a repeating unit structure (along with the central barrier and the electrical connecting means which electrically connects the anode to the cathode through the central barrier) are, of course, often referred to as a "bipolar electrode". This is because, in effect, this connection of structure series is as an anode in one electrolysis cell and a cathode in another electrolysis cell.

The above features of a flat plate bipolar electrode-type, filter press-type electrolytic cell unit can also be observed in the following references: U.S. Pat. Nos. 4,364,815; 4,111,779; 4,115,236; 4,017,375; 3,960,698; 3,859,197; 3,752,757; 4,194,670; 3,788,966; 3,884,781; 4,137,144; and 3,960,699.

A review of these patents discloses the above described structural elements in various forms, shapes and connecting means.

What is surprising to one not skilled in this art is the complexity of connections of these parts as well as the large number of parts required for what seems to be a relatively simple structural assembly problem. Of course, to those skilled in the art this complexity is well understood as the outgrowth of trying to make profitable commercial cell structures for use with the relatively new permselective ion-exchange membranes and the extremes of corrosive conditions extant between the anode and cathode compartments. These membranes operate best at elevated temperatures and high caustic concentrations, e.g., above about 80° C. and about 22% caustic catholyte concentrations. This compounds the problems of constructing profitable cells.

The problem centers around finding an affordable anode material and other materials which can withstand the extremely corrosive conditions of the anode compartment. For profitable, commercial operations, titanium is the material which has been found which has the most promise for profitable use.

However, there is a great disadvantage in the use of titanium with other metals suitable for use in the anode compartment. This is titanium's inability to form a good weld with ferrous materials and most other materials. This is most unfortunate because steel has been used quite successfully for many years as the cathode material.

The major reason for the complexity existing in the connections as well as the reason for having so many connections and so many separate parts in each filter press cell unit of the prior art stems from the necessity of using titanium coupled with the relatively high cost of titanium with respect to the cost of steel coupled with the necessity of establishing a very low electrical resistance connection between the anode and the cathode. The present invention greatly reduces the number of connections, number of separate parts, and the problems they cause. Further discussion of these problems will be better appreciated by perusing the prior art.

As stated above, one of the main problems is that titanium cannot be successfully welded directly to steel. See Seko, U.S. Pat. No. 4,111,779 at Column 1. Also see Mitchell, D. R.; Kessler, H. D.; "The Welding of Titanium to Steel", *Welding Journal* (December 1961). In the Seko patent, titanium is joined to steel by explosion bonding steel plate to titanium plate. In the Mitchell et al *Welding Journal* article, titanium is indirectly welded to steel by welding through a vanadium intermediate placed between the steel and titanium.

The prior art discloses complex and elaborate schemes devised to electrically and/or mechanically connect the different parts of the cell wherein titanium and titanium alloys are employed. Particularly is this complexity seen to be true with respect to the parts herein referred to as stand-offs which connect the "flat plate" anode and cathode of a bipolar electrode structure to an electrically conductive central barrier at a spaced distance from the central barrier; e.g. Seko U.S. Pat. Nos. 4,111,779 and Ichisaka et al, 4,194,670. Other stand-offs are used to support the flat plate electrodes and to electrically and mechanically connect them through holes in a non-conductive central barrier, e.g., Stephenson III, et al, U.S. Pat. Nos. 3,752,757 and Bortak, 3,960,698. It will be noticed that in these connections, welds and/or bolts are used to connect the stand-offs to the electrodes and then again to the central barrier or to opposing stand-offs passing through the central barrier. Many problems are associated with these many connections. These problems would not be so formidable if only a few connections were required for each of the many cells in a series, but many are required for each cell to get adequate electrical current distribution.

The present invention reduces these problems by eliminating many of these connections. It does this by integrally casting these stand-offs with the central barrier. Moreover, the connections used to connect the central barrier to the peripheral structure of the anolyte and cathode compartment are also eliminated by integrally casting these structures with the central barrier.

Other problems associated with having so many such conuections include unequal electrical current transfer, warpage of parts, and creation of more stress points in the titanium. Such stress points are subject to attack by atomic hydrogen as well as increased susceptibility to normal chemical corrosion and galvanic corrosion.

The electrical transfer capabiity of a bolted connection is dependent upon the sufficiency of the friction contact between the threads of the two mating threaded pieces. Many bolts are used in making the connections for each bipolar unit when they are depended upon to connect the electrodes and/or stand-offs. They are depended upon to carry equal amounts of current to avoid "hot spots" on the electrodes and adjacent membranes. However, this would require perfect equality of mating of all threaded surfaces. Perfection can not be closely approximated in these cells without going to extraordinary costs. Hence, "hot spots" do occur, and if they do not burn the membrane, they at least cause distorted electrolysis reaction rates across the face of the electrode.

As to welded connections, electrical transmission through them is dependent upon the percentage of the cross-sectional area of the supposed weld which is actually welded. Maldistribution of the amount of welded surface area from weld to weld across the face of a bipolar electrode is very difficult to avoid. Thus with maldistribution of welds, there occurs maldistribution of electric current which, like the threaded bolt problem, causes the undesired electrical "hot spots" on the membrane and "flat plate" electrodes.

Warpage is another undesired side effect of welding. Welding invariably causes warpage in the workpiece. Warpage problems may initially begin before fabrication. When working with large weldments, the individual parts themselves may not be straight, flat, smooth, etc., which will ultimately cause problems during and after fabrication. For proper alignment and positioning of parts, jigs and fixtures often are not adequate to compensate for such problems.

When working with large flat structures (such as cell bodies) the biggest concern lies with warpage that occurs due to the welding itself. Methods to correct such warpage may include heating/cooling, pressing, heating/pressing, and machining. All such methods of relieving warpage induced by welding, however, may in turn induce additional stresses in the structure and thereby cause secondary warpage in the part. These methods also increase the cost of the cell bodies.

In addition to warpage, other concerns which are common to welded structures include: (1) undesirable weld stresses within the part, (2) defective welds, (3) correcting welds which are defective, (4) examination of the weldment for flaws.

In both the all welded cell structures and the welded and bolted metal cell structures, it is difficult to maintain uniform planes between the anolyte and catholyte compartments. Consequently these non-uniform planes cause a non-uniform electrical current distribution across the active surface of the catholyte and anolyte chambers. Since the distribution of electric current is non-uniform, the electrical reactions are also non-uniform. It occurs vigorously at localized areas and thereby causes localized heating effects there, that is "hot spots".

Another problem associated with these non-uniform planes is that the anode and the cathode cannot be brought sufficiently close to each other without the fear of puncturing the membrane. Thus a large voltage loss is incurred because these electrodes can not be spaced as close to each other as desired.

All of the above leads to a shortening of the life of the electrolytic cell.

The present invention by comparison (cast unitary cell structures) has eliminated most of the problems listed above which are common to the weldment type structure and the welded and bolted structure. As a result, cell electrodes are more uniformly parallel; there is a more uniform distribution of electrical current and electrolytic reaction in the cell during operation; and the invention also provides a leakproof centerboard or central barrier.

Another undesired effect of threads and welds in titanium is that they create stress points in the titanium. These stress points are very susceptible to attack by atomic hydrogen. This attack forms significant concentrations of hydrides of titanium at temperatures greater than 80° C. These hydrides are structurally unsound and resistant to the passage of electricity. Thus the purposes for which these threads or welds were made in the first place are substantially undone when hydrides are formed thereat.

The source of this atomic hydrogen is primarily the cathode compartment where water is electrolyzed to hydrogen and hydroxide. It would seem that little trouble would be expected in titanium located in the anode compartment from atomic hydrogen generated in the cathode compartment, particularly when there is a steel central barrier located between them.

However, this hydrogen diffuses through the steel and does attack titanium stress points with particular devastating results at temperatures greater than 80° C., the temperature above which membrane cells coincidently seem to operate best.

The atomic hydrogen attacks the titanium stress points directly connected to the steel. This is one of the flaws in the reasoning given for using a steel to titanium explosion bonded central barrier as is disclosed and claimed in Seko, U.S. Pat. No. 4,111,779. The whole bonded area of the titanium is under stress and is therefore subject to the hydride formation discussed above. At first no problem is detected because sufficient hydrogen has not penetrated the steel and reached the titanium. However, as the titanium hydride formation increases in these central barriers at the titanium steel bond, the electrical conductivity and the structural integrity decreases.

Stabilized electrocatalysts have been used as electrodes in processes and devices for the generation of chlorine and hydrogen by electrolysis of an aqueous alkali metal halide at the anode of an electrolysis cell and of water at the cathode of an electrolysis cell which includes a solid polymer electrolyte in the form of a cation exchange membrane to separate the cell into cathode and anode compartments. The catalytic electrodes at which the chlorine and hydrogen are produced are thin, porous, gas permeable catalytic electrodes which are bonded to or embedded in opposite surfaces of the membrane so that the chlorine and hydrogen are generated (substantially) at the electrode membrane interfaces. This results in electrodes which have very low overvoltages for chlorine and hydrogen discharge.

The present invention greatly reduces the risk of titanium hydride formation by creating a structure which has a titanium liner with only a relatively very few stress points in it, and also by locating these stress points at an extreme distance from the hydrogen source with respect to the amount of steel which must be traversed in order to reach any of these few stress points. The only stress points found in the present invention's titanium hot pressed liner are found at the sites where it is welded to the ends of the integrally cast anode bosses. These will be discussed below. It should be understood here, however, that although the present invention has been discussed principally in terms of the commonly used steel and titanium, it is not limited to these materias of construction, albeit they are the preferred material of construction.

SUMMARY OF THE INVENTION

The present invention is a solid polymer electrolyte cell structure used in forming a bipolar electrode, filter press, solid polymer electrolyte, electrolytic cell unit, which unit is capable of being combined with other cell units to form a cell series;

wherein in said series the cell structure is separated from adjacent cell structures by ion-exchange permselective solid polymer electrolyte membranes which are sealably disposed between each of the cell structures so as to form a plurality of electrolysis cells;

each of said electrolysis cells has at least one planarly disposed solid polymer electrolyte membrane separating the anode compartment and cathode compartment of each electrolysis cell;

said cell structure has a central barrier which physically separates an anode compartment of an electrolysis cell located on one side of the barrier from a cathode compartment of an adjacent electrolysis cell located on the opposite side of the barrier;

said central barrier at least has a planarly disposed anode component situated in its adjacent anode compartment and at least has a planarly disposed cathode component situated in its adjacent cathode compartment;

said central barrier has the anode component of the adjacent anode compartment electrically connected through it to the cathode component of the adjacent cathode compartment;

said anode and cathode compartments which are adjacent to the central barrier have a peripheral structure around their periphery to complete the physical definition of said compartment;

said cell structure also has an electrical current transfer means associated with it for providing electrical current paths through the central barrier from its adJacent cathode compartment to its adjacent anode compartment; and said cell structure also includes anode component and cathode component stand-off means for maintaining the anode component and cathode component of the two electrolysis cells adjacent to the central barrier at a predetermined distances from the central barrier.

The improvement comprises:

the central barrier, the anode and cathode compartment peripheral structures, the anode component stand-off means, the cathode component stand-off means, and at least part of the electrical current transfer means all being integrally formed into a unitary central cell element made from a castable material;

said castable material being electrically conductive so as to be the part of the electrical current transfer means which transfers electricity through the central barrier from the adjacent cathode compartment to the adjacent anode compartment;

said unitary central cell element being formed in such a fashion so as to provide the structural integrity required to physically support the contents of the adjacent electrolyte compartments as well as to support the associated electrolysis cell appurtenances which are desired to be supported by the unitary central cell element; and said anode component stand-off means and that part of the electrical current connecting means located in the unitary central cell element on the anode side of the central barrier being combined into a multiplicity of anode component bosses projecting a predetermined distance outwardly from the central barrier into the anode compartment adjacent to the central barrier, said anode component bosses being capable of being mechanically and electrically connected either directy or indirectly to the anode component of said anode compartment;

said cathode component stand-off means and that part of the electrical current connecting means located on the cathode side of the central barrier being combined into a multiplicity of cathode component bosses projecting a predetermined distance outwardly from the central barrier into the cathode compartment adjacent to the central barrier, said cathode component bosses being capable of being mechanically and electrically connected either directly or indirectly to the cathode component;

said anode component bosses being spaced apart in a fashion such that fluids can freely circulate throughout the totality of the adjacent anode compartment, and, likewise, said cathode component bosses being spaced apart in a fashion such that fluids can freely circulate throughout the totality of the adjacent cathode compartment;

at least one of said electrode component comprising:

an interconnected, electrically conductive, electrocatalytic material bonded to or pressed against the ion exchange solid polymer electrolyte membrane, and a hydraulically permeable current collector electrically connected to said interconnected, electrically conductive, electrocatalytic material and to said electrode bosses.

Exemplary electrocatalyst materials for use in forming the anodes of solid polymer electrodes of the present invention include the platinum group metals as well as oxides and oxycompounds thereof, for example, platinum black, and isostructural oxycompounds such as platinum group metal perovskites, platinum group metal spinels and platinum group metal crystal defect semiconductors. An exemplary crystal defect semiconductor is the isostructural ruthenium dioxide-titanium dioxide. By oxycompounds of the platinum group metals are meant compositions of the platinum group with oxygen and another metal, as in spinels, perovskites, delafosites, and semiconductive oxides.

Exemplary electrocatalyst materials for use in forming the cathodes of solid polymer electrodes of the present invention include the transition metals of group 8 of the Periodic Table, as exemplified by iron, cobalt and nickel, especially when present in forms having enhanced surface area, i.e., enhanced surface activity. The high surface area forms include leached codeposits of the transition metal with zinc, leached deposited Raney alloys, and blacks, for exampe, platinum black, palladium black and the like.

The electrocatalytic materials suitable for use in the present invention may be bonded to and embedded in a fluorocarbon, for example, in a thermoplastic fluorocarbon, or hot pressed to a thermoplastic fluorocarbon or to the permionic solid polymer electrolyte membrane, or sintered, for example with polytetrafluoroethylene. The electrocatalyst may be blended with other materials, such as graphite or silver for enhanced electrical conductivity. The fluorocarbon may itself have porosity, as provided by abrasion, a leachable pore forming material, or a volatile pore forming material. See U.S. Pat. No. 4,457,815.

Preferably, the electrocatalytic particles comprising the electrode (cathode or anode) are as fine a powder as is practical for use. Preferably, the size of the particles are such that they pass through a 400 mesh U.S.S. Standard nylon screen.

Preferably, the surface area of the particles, as observed by the BET nitrogen absorption method, have a surface area of at least about 25 square meters per gram of electrocatalytic particles. More preferably, they have a surface area of from about 50 to about 150 square meters per gram of electrocatalytic particles. See U.S. Pat. No. 4,457,823.

The invention preferably further comprises anode bosses being spaced apart in a fashion such that fluids can freely circulate through the totality of the otherwise unoccupied adjacent anode compartment, and, likewise, said cathode bosses being spaced apart in a fashion such that fluids can freely circulate throughout the totality of the otherwise unoccupied adjacent cathode compartment.

Preferably the castable material of the unitary central cell element is selected from the group consisting of iron, steel, stainless steel, nickel, aluminum, copper, chromium, magnesium, tantalum, cadmium, zirconium, lead, zinc, vanadium, tungsten, iridium, rhodium, cobalt, alloys of each, and alloys thereof.

More preferably the metal of the unitary cell element is selected from the group consisting of ferrous materials. Ferrous materials are defined herein to mean metallic materials whose primary constituent is iron.

A further element which this invention preferably includes is an anode side liner made of a metal sheet fitted over those surfaces on the anode compartment side of the cell structure which would otherwise be exposed to the corrosive environment of the anolyte compartments.

Preferably this anode side liner is an electrically conductive metal which is essentially resistant to corrosion due to the anode compartment environment, and preferably the metal liner is formed so as to fit over and around the anode bosses with the liner being connected to the unitary central cell element at the anode bosses more preferably connected at the ends of the anode bosses.

And preferably the invention comprises having the liner sufficiently depressed around the spaced anode bosses toward the central barrier in the spaces between the bosses so as to allow free circulation of the fluids between the lined unitary central cell element and the solid polymer electrolyte membrane of the adjacent anode compartment. Note that the liner replaces the unitary central cell element surface adjacent to the anode compartment as one boundary contacting the anolyte.

More preferably, the metal liner is connected to the anode bosses by welding through a metal intermediate which is disposed between the bosses and the liner with the metal of the metal intermediate being weldably compatible with both the metal of the anolyte side liner and the metal of which the unitary central cell element is made, that is, weldably compatible with both metals to the point of being capable of forming a ductile solid solution with them at welds of them upon their welding.

In most cases, such as in the construction of chlor-alkali cells, it is preferred that the unitary cell element be made of a ferrous material and the anolyte side liner be made of a metallic material selected from the group consisting of titanium, titanium alloys, tantalum, tantalum alloys, niobium, niobium alloys, hafnium, hafnium alloys, zirconium and zirconium alloys.

In situations where the anode side liner metal is not weldably compatible with the metal of the unitary cell element, then in order to be able to weld the liner to the structure, metal coupons are one type of metal intermediate which are suitable to be situated in an abutting fashion between the anode bosses and lhe anolyte side liner. Each coupon has at least two metal layers bonded together, with the outside metal layer of one side of the coupon abutting the anode boss and the outside metal layer of the opposite side of the coupon abutting the anode side liner. The metal layer of the coupons which abuts each anode boss is weldably compatible with the material of which the anode bosses are made and accordingly being welded to said anode bosses. The metal layer of that side of the coupons abutting the anode side liner is weldably compatible with the metallic material of which the anode side liner is made and accordingly is welded to said liner so that the liner is welded to the anode bosses through the coupons. In some instances wafers made of a single metal or metal alloy serve quite well as intermediates.

In most cases, it is preferred that the anode side liner be made of titanium or a titanium alloy, and the castable material from which the unitary central cell element be made is a ferrous material.

In the situation where the anode liner is titanium material and the anode bosses are a ferrous material, then it is preferred to have vanadium wafers serve as the weldably compatible metal intermediates interposed between the anode bosses and the adjacent anolyte side liner so that the titanium anode side liner can be welded to the ferrous material anode bosses through the vanadium wafers. Vanadium is a metal which is weldably compatible with both titanium and ferrous material.

In some instances it is preferred to have the metal intermediates situated between the anode bosses and the adjacent anode side liner joined to the ends of the anode bosses by a film-forming process. Spraying a hot liquid metal, such as vanadium, is one film forming process. Another film forming process is carried out by soldering or brazing the metal to the anode bosses.

In some rare occasions it is found that no metal intermediate is required to be used between the liner and the anode bosses, and that the anolyte side liner can be directly bonded to the anode bosses by welding.

Another way of connecting an anode liner to the unitary cell structure when these metals are weldably incompatible is that where no metal intermediate is used, but wherein the anode side liner is bonded directly to the anode bosses by explosion bonding or diffusion bonding.

In many instances it is desired that the anode side metal liner extends over the lateral face of the anode compartment peripheral structure so as to form a sealing face thereat for the solid polymer electrolyte membrane when the cell segments are squeezed together to form a cell series.

In most instances it is desired that the anode side liner be connected to the unitary central cell element at the ends of the anode bosses. However, this invention includes connecting the liner to the sides of these bosses and even connecting the liner to the central barrier between the bosses. Preferably, however, the anode side liner is welded to the ends of the anode bosses through an intermediate metal coupon or wafer.

A cathode side liner is usually required less frequently than an anode side liner. However, there are many occasions, such as in high concentration caustic cathode compartments, wherein a cathode side liner is needed on the cathode side of the unitary cell element. Thus this invention also comprises a cathode side liner made of a metal sheet fitted over those surfaces of the unitary central cell element which would otherwise be exposed to the cathode compartment of the adjacent electrolysis cell.

This cathode side liner is made from an electrically conductive metal which is essentially resistant to corrosion due to the cathode compartment environment. Plastic liners may be used in come cases where provision is made for electrically connecting the cathode to the cathode bosses through the plastic. Also combinations of plastic and metal liners may be used. The same is true for anode side liners.

The cathode side liner is depressed sufficiently around the spaced cathode bosses toward the central barrier in the spaces between the bosses so as to allow free circulation of the fluids between the lined unitary central cell element and the solid polymer electrolyte membrane of the adjacent cathode compartment. Note that the liner replaces the unitary central cell element surface adjacent to the cathode compartment as one boundary contacting the catholyte.

Unlike the anode side liner, it is preferred that the metal cathode side liner be directly connected to the cathode bosses by welding without a metal intermediate being disposed between the bosses and the liner. A metal intermediate can be used, however. If so, then the metal intermediate must be weldably compatible with both the metal of the cathode side liner and the metal of which the unitary cell element is made.

In many instances it is desired that the unitary cell element be made of a ferrous material and the metal for the oathode side liner be selected from the group consisting of ferrous materials, nickel, nickel alloys, chromium, magnesium, tantalum, cadmium, zirconium, lead, zinc, vanadium, tungsten, iridium, and cobalt.

In many instances it is desired that the metal of the unitary central cell element, of the cathode side liner, and of the cathode of the adjacent electrolysis cell be all selected from the group consisting of ferrous materials.

In some instances it is preferred to have the metal intermediates situated between the cathode bosses and the adjacent cathode side liner joined to the ends of the cathode bosses by a film-forming process. Spraying a hot liquid metal is one film-forming process. Another film-forming process is carried out by soldering or brazing the metal to the cathode bosses.

However, in most cases, the metal of the cathode liner can be welded directly to the unitary cell structure without the need of metal intermediate. Nickel is usually the most preferred cathode side liner material.

The cathode side metal liner is formed so as to fit over and around the ends of the cathode bosses and is welded directly on one side of the liner to the bosses in a manner so as to provide an electrical connection between the unitary central cell element and the cathode. The cathode itself is directly welded to the opposite side of the cathode side liner.

As with the anode side liner, it is preferred that the cathode side metal liner also extend over the lateral face of the cathode compartment peripheral structure so as to form a sealing face thereat for the solid polymer electrolyte membrane when the cell segments are squeezed together to form a cell series.

In most instances it is desired that the catholyte side liner be connected to the unitary central cell element at the ends of the cathode bosses. However, this invention includes connecting the liner to the central barrier between the bosses.

BRIEF DESCRIPTION OF THE DRAWINGS

The invention can be better understood by reference to the drawing illustrating the preferred embodiment of the invention, and wherein like reference numerals refer to like parts in the different drawing figures, and wherein.

DETAILED DESCRIPTION OF THE PREFERRED EMBODIMENT OF THE INVENTION

Figure 1:
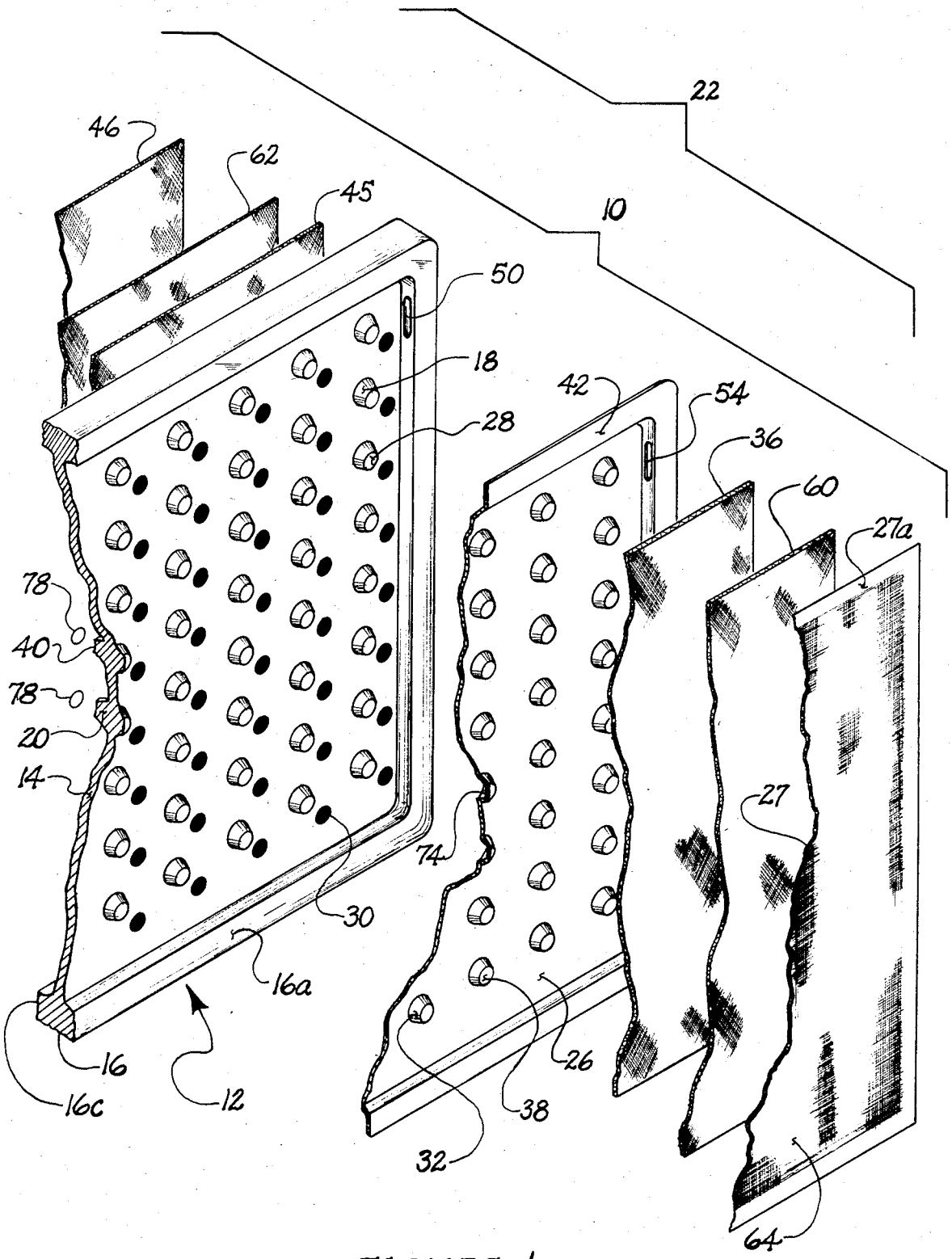
FIG. 1 is an exploded, partially broken-away perspective view of one embodiment of the present invention showing the unitary cell element 12 with accompanying parts forming one, solid polymer electrolyte bipolar electrode type filter press-type cell unit 10 of a cell series of such cell units.
Figure 2:
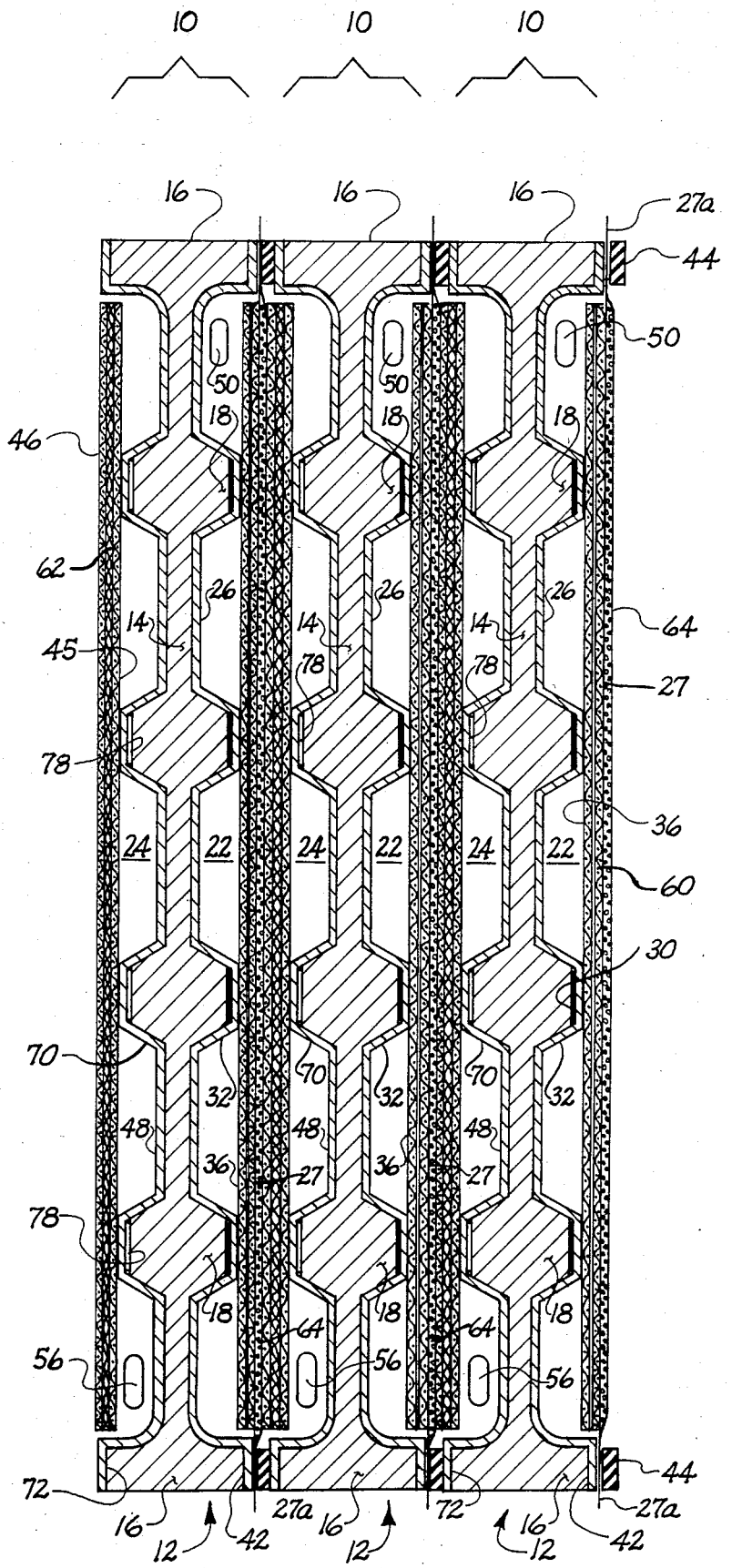
FIG. 2 is a cross-sectional side view of three solid polymer electrolyte, filter press-type cell units 10 employing the unitary cell elements 12, said cell units shown as one embodiment of how they appear in a solid polymer filter press cell series.
Figure 3:
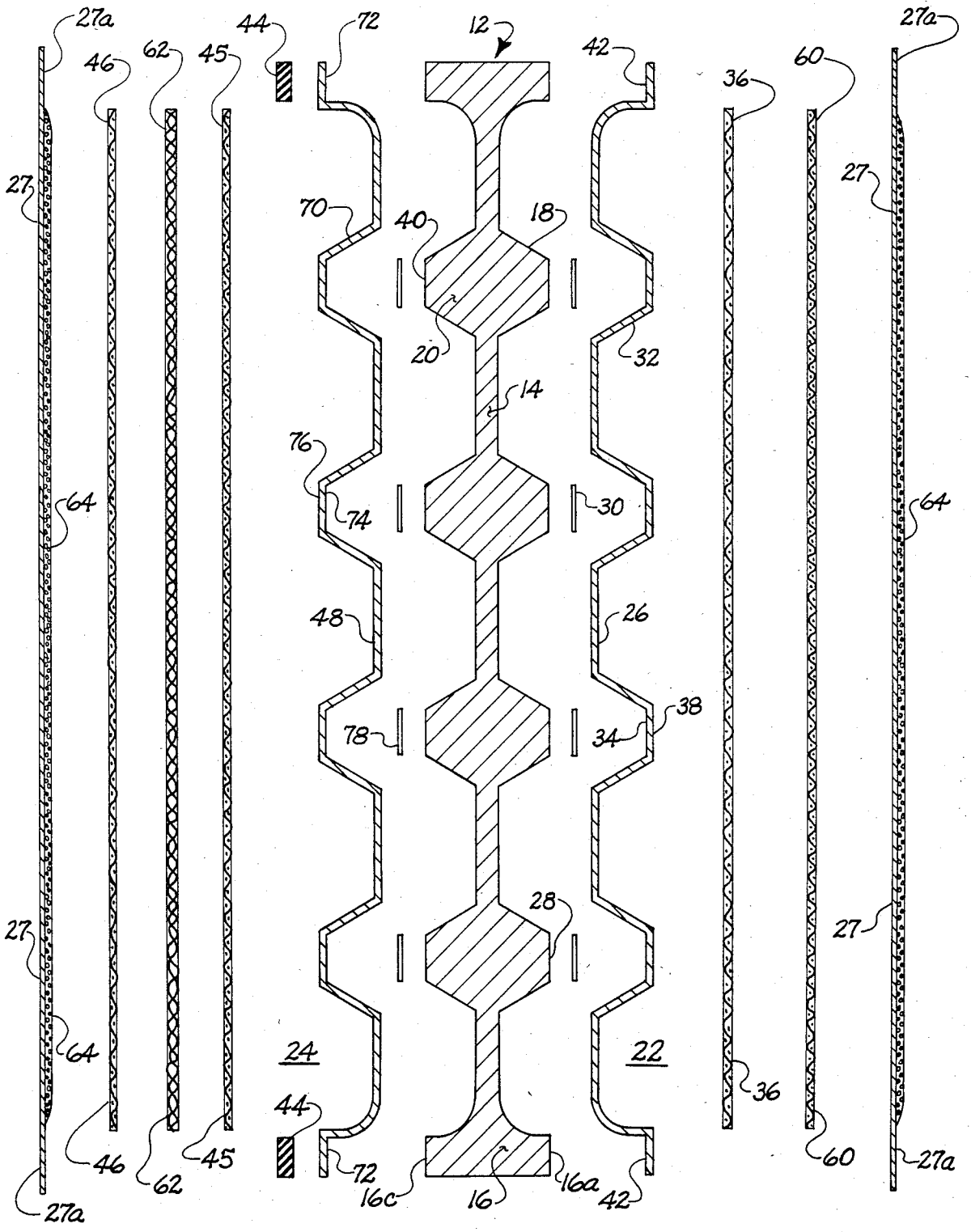
FIG. 3 is an exploded, sectional side view of the cell structure used in forming a solid polymer electrolyte bipolar electrode-type, filter press-type cell unit 10 which employs the unitary central cell element 12.

Referring to FIGS. 1, 2 and 3, a solid polymer electrolyte, "flat plate" electrode-type bipolar electrode-type, filter press-type electrolysis cell unit 10 is shown employing the unitary central cell element 12.

In a preferred embodiment, unitary central cell unit 12 is made of ductile iron. It has a solid central barrier 14, a peripheral flange 16 extending laterally from both sides of the periphery of the central barrier 14, protruding and spaced-apart anode bosses 18, and protruding and spaced-apart cathode bosses 20.

By having these parts all integrally cast into one unit 12, many problems are simultaneously eliminated or greatly reduced. For example, most of the warpage problems, fluid leakage problems, electric current maldistribution problems, and complications of cell construction on a mass production basis are greatly alleviated. This simplicity of cell design allows cell units to be constructed which are much more reliable, but which are constructed at a much more economical cost. Optionally, however, the stand-off means may be constructed of a material different from the remaining portions of the central barrier.

Referring to FIGS. 1, 2 and 3, an anode compartment 22 of an adjacent electrolysis cell can be seen on the right side of central cell element 12. On the left side of cell structure 12, a cathode compartment 24 of a second adjacent electrolysis cell can be seen. Thus cell element 12 separates one electrolysis cell from another. One very important feature in cells of this type is to get electricity from one electrolysis cell to another as cheaply as possible.

On the anode compartment side (the right side on FIGS. 1, 2 and 3) of central structure 12, there is an anolyte side liner 26 made of a single sheet of thin titanium. This liner 26 may be hot formed by a press in such a fashion so as to fit over and substantially against the surfaces of the unitary central cell unit 12 on its anode compartment side. This is done to protect the iron of cell structure 12 from the corrosive environment of the anode compartment 22 (FIG. 3). Anolyte side liner 26 also forms the left boundary of anode compartment 22 with ion-exchange solid polymer electrolyte membrane 27 forming the right boundary (as shown in FIG. 3). Unitary cell element 12 is case in such a fashion so that its peripheral structure forms a flange 16 which serves not only as the peripheral boundary of the anode compartment 22 but also as the peripheral boundary of the cathode compartment 24. Preferably the titanium liner is formed with minimum stress in it, in order to provide a liner which atomic hydrogen can not attack as rapidly to form brittle, electrically non-conductive titanium hydrides. Atomic hydrogen is known to attack stressed titanium more rapidly. Avoiding these stresses in the liner may be accomplished by hot forming the liner in a press at an elevated temperature of about 900° F. to about 1,000° F. Both the liner metal and press are heated to this elevated temperature before pressing the liner into the desired shape. The liner is then held in the heated press for about forty-five minutes to prevent formation of stresses in it as it cools to room temperature.

Titanium anode side liner 26 is connected to ductile iron cell element 12 by resistance welding or capacitance discharge welding. This welding is accomplished indirectly by welding the anode side liner 26 to the flat ends 28 of the frustroconically shaped, solid anode bosses 18 through vanadium wafers 30. Vanadium is a metal which is weldable itself and which is weldably compatible with titanium and ductile iron. Weldably compatible means that one weldable metal will form a ductile solid solution with another weldable metal upon the welding of the two metals together. Titanium and ductile iron are not weldably compatible with each other, but both are weldably compatible with vanadium. Hence, vanadium wafers 30 are used as an intermediate metal between the ductile iron anode bosses 18 and the titanium liner 26 to accomplish the welding of them together to form an electrical connection between liner 26 and central cell element 12 as well as to form a mechanical support means for central cell element 12 to supporting anode side liner 26.

The preferred fit of the anode side liner 26 against the central cell element 12 can be seen from the drawings. The liner 26 has indented hollow caps 32 pressed into it. These caps 32 are frustroconically shaped, but are hollow instead of being solid as are the anode bosses 18. Caps 32 are sized and spaced so that they fit over and around anode bosses 18. Caps 32 are sized in depth of depression so that their interior ends 34 abut the vanadium wafers 30 when the vanadium wafers 30 are abutting the flat ends 28 of the anode bosses 18 and when these elements are welded together. The shape of these bosses and caps is not significant. They could be square shaped or any other convenient shape. However, their ends 28 should all be flat and should all lie in the same imaginary geometrical plane in the preferred embodiment. In fact these anode bosses and caps can be shaped and located so as to guide anolyte and gas circulation.

The titanium anode side liner pan 26 is resistance welded at the interior ends 34 of its indented caps 32 to the ductile iron ends 28 of anode bosses 18 through the interposed, weldably compatible, vanadium wafers 30.

Primary anode 36 is preferably a substantially flat sheet of perforated metal, expanded metal or woven wire made of titanium having a ruthenium oxide catalyst coating on it. Preferably, it is welded directly to the outside of the flat ends 38 of indented caps 32 of titanium liner 26. These welds form an electrical connection and a mechanical support means for primary anode 36. A secondary anode 60 is positioned between the primary anode and the solid polymer electrolyte membrane. It is preferably welded to the primary anode 36. Neither, either or both, the primary anode 36 and secondary anode 60 may be catalytically coated. Other catalyst coatings can be used.

In FIG. 2, solid polymer electrolyte membrane 27 is seen to be disposed in a flat plane between the secondary anode 60 of one filter press cell unit 10 and the secondary cathode component 46 of the next adjacent filter press cell unit 10 so as to form an electrolysis cell between the central barrier 14 of each of the two adjacent unitary central cell elements 12.

Representative of the types of permselective membranes envisioned for use with this invention are those disclosed in the following U.S. Pat Nos. 3,909,378; 4,329,435; 4,065,366; 4,116,888; 4,126,588; 4,209,635; 4,212,713; 4,251,333; 4,270,996; 4,123,336; 4,151,053; 4,176,215; 4,178,218; 4,340,680; 4,357,218; 4,025,405; 4,192,725; 4,330,654; 4,337,137; 4,337,211; 4,358,412; and 4,358,545. These patents are hereby incorporated by reference.

Solid polymer electrolyte membranes are an ion exchange membrane having an electrically conductive, electrocatalytic material embedded in or bonded to the ion exchange membrane. Such electrodes are well known in the art and are illustrated in, for example, U.S. Pat. Nos. 4,457,815 and 4,457,823. These two patents are hereby incorporated by reference for the purposes of the solid polymer electrolyte electrodes which they teach. One or both sides may be coated. FIG. 1 illustrates a solid polymer electrolyte with only a cathode electrocatalyst. A portion of the ion exchange membrane may not be coated at all; for instance, in the peripheral or gasketed areas.

In addition, other anode and cathode components may be used in the cell of the present invention. For example, the mattress structure taught in U.S. Pat. No. 4,444,632 may be used to hold the ion exchange membrane and at least one of the electrodes in physical contact. Various mattress configurations are illustrated in U.S. Pat. No. 4,340,452. The mattresses illustrated in U.S. Pat. No. 4,340,452 may be used with both solid polymer electrolyte cells. These patents are incorporated by reference for the purposes of the resilient cell elements that they teach.

The cells of the present invention may be used with anode and cathode components other than, or in addition to, the components listed above. For example, the cell may include current collectors which distribute electrical current to the electrodes of the cells. Current collectors may be conveniently used with solid polymer electrolyte cels. Current collectors are illustrated in, for example, U.S. Pat. No. 4,444,641. That patent is hereby incorporated by reference for the purposes of its teaching about current collectors.

Of course, it is within the scope of this invention for the electrolysis cell formed between the two cell segments to be a multi-compartment electrolysis cell using more than one solid polymer electrolyte membrane, e.g., a three-compartment cell with one membrane and one solid polymer electrolyte membrane spaced from one another so as to form a compartment between them as well as the compartment formed on the opposite side of each between the separator and its respective adjacent filter press cell unit 10.

For fluid sealing purposes between an area **27*a* of the solid polymer electrolyte membrane not having electrocatalytically active particles, and flange surface 16*a*, it is preferred for anode side liner 26 to be formed in the shape of a pan with an off-set lip 42 extending around its periphery. Lip 42 fits flush against the anolyte side of lateral face 16***a* of flange 16, this lateral face 16*a* being located on the anode side of the cell structure 12. The periphery 27*a* of solid polymer electrolyte membrane 27 fits flush against anode side liner lip 42, and a peripheral gasket 44 fits flush against the other side of the periphery of solid polymer electrolyte membrane 27. In a cell series, as shown in FIG. 2, the gasket 44 fits flush against the cathode side liner lip 72 on the cathode side of the next adjacent cell structure 12 and flush against solid polymer electrolyte membrane periphery 27*a*.

Although only one gasket 44 is shown, this invention certainly encompasses the use of gaskets on both sides of solid polymer electrolyte membrane 27. It also encompasses the situation where no lips 42 or 72 are used.

On the side of ductile iron central cell element 12 opposite the anode compartment side, i.e., the cathode side, there is no cathode side liner shown in FIG. 1, although there is a catholyte side liner 48 shown in FIGS. 2 and 3. This is done to illustrate the fact that the presence of two liners is sometimes desired but sometimes not. Most often the metal from which central cell element 12 is cast is also suitable for use in either the cathode compartment 24 or the anode compartment 22. For example, in an electrolysis cell series wherein aqueous solutions of sodium chloride are electrolyzed to form caustic and/or hydrogen gas in the cathode compartment 24, then ferrous materials such as steel are quite suitable for the cathode compartment metal components at most cell operating temperatures and caustic concentrations, e.g., below about 22% caustic, concentration and at cell operating temperatures below about 85° C. Hence, if cell element 12 is made of a ferrous material such as steel, and if caustic is produced at concentrations ower than about 22% and the cell is to be operated below about 85° C., then a protective liner is not needed on the cathode side of cell structure 12 to protect the steel cell element 12 from corrosion. But the titanium anode side liner 26 is still needed on its anode side. Hence, in FIG. 1, there is no cathode side liner 48 shown. Instead the flat foraminous metal cathode component 45 (also made of ductile iron, in this embodiment in FIG. 1) is resistance or capacitance discharged welded directly to the ends 40 of frustroconically shaped cathode bosses 20.

Referring to FIGS. 2 and 3, therein the cathode side (the left side) of cell element 12 is seen to appear as the mirror image of its anode side. The flange 16 forms the peripheral boundary of the cathode compartment 24, while the central barrier 14 and solid polymer electrolyte membrane 27 form its remaining boundaries. Spaced cathode bosses 20 are solid, frustroconically shaped protrusions extending outwardly from central barrier 14 into cathode compartment 24. Flat-surfaced, foraminous, steel plate cathode component 45 is welded directly to the flattened ends 40 of cathode bosses 20 and no cathode side liner 48 is used. Again the shape of the bosses 20 are not important. They are preferably flat on their ends 40 and these ends 40 preferably all lie in the same geometrical plane.

When a metal liner is desired on the cathode compartment side of unitary central cell element 12, it can easily be provided in the same manner and with similar limitations as is the anode compartment side liner 26 provided for anode compartment side of cell element 12, described above. Referring to FIGS. 2 and 3, such a cathode side liner 48 is shown. It is made of a metal which is highly resistant to corrosive attack from the environment of the cathode compartment 24. The metal must also be sufficiently ductile and workable so as to be pressed from a single sheet of metal into the non-planar form shown. This includes being capable of having the frustroconically shaped cathode boss indented caps 70 pressed into the single sheet. Of course, these cathode boss caps 70 must be spaced so that they fit over and around the spaced cathode bosses 20 as well as the other parts of the side of the central cell element 12 which would otherwise be exposed to the environment of the cathode compartment 24. It is preferred that this cathode side liner 48 have an indented lip 72 extending around its periphery in a fashion so as to flushly abut the lateral face 16*c* of flange 16 on the side of central cell element 12 which is adjacent to the cathode compartment 24. Liner 48 is preferably connected to central cell element 12 by resistance or capacitor discharge welding of the liner caps' internal ends directly, in an abutting fashion, to the flat ends 40 of cathode bosses 20. That is, this is preferable if the metal of the liner 48 and the central support element 12 are weldably compatible with each other. If these metals are not weldably compatible, then there should be used metal intermediates or combinations of intermediates which are weldably compatible with the metal of liner 48 and cell element 12. These intermediates 78 are disposed between the cathode boss flat ends 40 and the liner caps' interior ends 74 which correspond to the boss ends 40.

Metal intermediates 78 are welded to the ends 40 of cathode bosses 20. Cathode side liner 48 is then welded indirectly to the ends 40 of cathode bosses 20 by resistance or capacitor discharge welding on the interior ends 74 of cathode side liner caps 70 through metal intermediates 78. Primary cathode component 45 is welded to the external end 76 of caps 70. Note that the connection of each liner cap 70 through a metal intermediate 78 to the end 40 of a cathode boss 20 may be made with only one weld; i.e., the metal intermediate does not have to be welded by itself beforehand.

Metal intermediates 78, 30 for both the anode side and cathode side may be metal wafers or metal coupons. By metal wafers, it is meant that the wafer be a single metal which is weldably compatible with both the metal of the cell element 12 and the metal of the respective liners 26 or 48. By metal coupons it is meant at least two layers of different metals bonded together to make up such a metal intermediate 78 or 30. The metals of such a coupon can be bonded together by methods such as explosion bonding. The ultimate criteria for such intermediates are that: they be highly electrically conductive; the metal lying against the cell element 12 be weldably compatible with the cell element metal; and the metal layer of the coupon laying against the liner be weldably compatible with the metal of that liner. It should be noted that coupons can have more than two layers of metal. One such coupon for the anode compartment side is a three layer explosion bonded coupon of titanium, copper and a ferrous material.

The active cathode 64 of the present cell is composed of a plurality of electrocatalytic and conductive particles bonded to or embedded into the ion exchange solid polymer electrolyte membrane. To conduct electrical energy to the plurality of particles acting as the cathode, a secondary cathode 46 is pressed against the particle-embedded solid polymer electrolyte membrane. A mattress 62 is pressed against the secondary cathode 46 to hold the secondary cathode 46 firmly against the cathode particles 64. A primary cathode 45 is positioned between the mattress 62 and the cathode side liner pan 76. The primary cathode 45 conducts electrical energy from the cathode liner pan 76 to the mattress 62.

In operating the cell series as an electrolysis cell series for NaCl brine, certain operating conditions are preferred. In the anode compartment a pH of from about 0.5 to about 5.0 is desired to be maintained. The feed brine preferably contains only minor amounts of multivalent cations (less than about 0.08 milligrams/liter when expressed as calcium). More multivalent cation concentration is tolerated with the same beneficial results if the feed brine contains carbon dioxide in concentrations lower than about 70 ppm when the pH of the feed brine is lower than 3.5. Operating temperatures can range from 0° to 250° C., but preferably above about 60° C. Brine purified from multivalent cations by ion-exchange resins after conventional brine treatment has occurred is particularly useful in prolonging the life of the solid polymer electrolyte membrane. A low iron content in the feed brine is desired to prolong the life of the solid polymer electrolyte membrane. Preferably the pH of the brine feed is maintained at a pH below 4.0 by the addition of hydrochloric acid.

Preferably the operating pressure is maintained at less than 7 atmospheres.

Usually the cell is operated at a current density of from about 1.0 to about 4.0 amperes per square inch, but in some cases operating above 4.0 amps/in.$^2$ is quite acceptable.

Now to the case where a metal liner is desired on both sides of the cell structure in a chlor-alkali cell. In the example given above for electrolyzing sodium chloride brine, a cathode side, single piece metal liner 48 made of nickel is desired when the caustic concentration in the cathode compartment 24 is maintained above about 22 wt. % and the cell electrolyte operating temperature is maintained above about 80° C. This nickel liner 48 is formed, sized for, and fitted to the central cell element 12 in essentially the same manner as is the titanium liner 26 on the anolyte side. However, since nickel and ductile iron are weldably compatible together themselves, there is no need to have a metal intermediate situated between them at the locations where the welds connecting the cathode side liner 48 to the cathode boss ends 40 are located. This is not to say, however, that this invention excludes the use of weldably compatible metal intermediates between the cathode bosses 20 and the catholyte liner 48. A liner may be used on one side, on both sides, or on neither side of unitary cell element 12.

Anode compartment 22 and cathode compartment 24 both need fluid inlet and outlet ducts. Accordingly an anode compartment orifice inlet duct (not shown), an anode compartment orifice outlet duct 50, a cathode compartment orifice inlet duct 56, and a cathode compartment orifice outlet duct (not shown) are cast in the body of the flange 16 in that part of the flange which contacts their respective anode compartment 22 and cathode compartment 24. When there are liners 26, 48 in these compartments, then corresponding orifices are provided in the liners. Examples of these orifices can be seen in FIG. 1 wherein an anode compartment orifice outlet 50 is shown cast in central oell element 12 and a corresponding anolyte liner outlet orifice 54 is shown formed in anolyte side liner 26. Anolyte side liner outlet orifice 50 and catholyte side inlet orifice 56 can be seen in FIG. 2.

Now turning to a more general description of the invention. Besides ferrous materials such as iron, steel and stainless steel, cell element 12 can also be cast from any other castable metal or metal alloy such as nickel, aluminum, copper, chromium, magnesium, titanium, tantalum, cadmium, zirconium, lead, zinc, vanadium, tungsten, iridium, rhodium, cobalt, and their alloys.

The anode side liner 26 and the cathode side liners 48 are preferably made of sufficiently workable metallic materials as to be capable of a single sheet of it being formed into the shape in which they are shown in the drawing. This includes the ability to be pressed so that they have frustroconically shaped caps 32 and 70. It should also be understood that the invention is not limited to the caps 32, 70 being frustroconically shaped nor limited to the anode and cathode bosses 18 and 20 being frustroconically shaped. They can be shaped and located so as to direct the flow of electrolytes and gas within the compartments 22 and 24. Bosses 18 and 20 should have their ends 28 and 40 flat and parallel with the flat electrode surface to which they are going to be connected. The ends 28 and 40 of the bosses 18 and 20 should present sufficient surface area to which electrical connections can be made to their respective electrodes to provide an electrical path with sufficiently low electrical resistance. The bosses 18 and 20 should be spaced so they provide a fairly uniform and fairly low electrical potential gradient across the face of the electrode to which they are attached. They should be spaced so that they allow free fluid circulation from any unoccupied point within their respective electroyte compartment to any other unoccupied point within that compartment. Thus the bosses will be fairly uniformy spaced apart from one another in their respective compartments. It should be noted here that although anode bosses 18 and cathode bosses 20 are shown in a back to back relationship across central barrier 14, they need not be. They can be offset from each other across barrier 14.

The materials from which anode and cathode bosses 18 and 20 are made may be the same or different as that of the cell element 12. To make them different, rods may be inserted into the mold prior to casting the material for the central barrier.

As to the anode side and cathode side liners 26 and 48, they are required to be electrically conductive, resistant to chemical attack from the electrolyte compartment environment to which they are exposed, and sufficiently ductile to form the indented caps 32, 70.

Of course, the metals from which anode side liner 26 and cathode side liner 48 are made are usually different because of the different electrolyte corrosion and electrolytic corrosion conditions to which they are exposed. This is true not only in chlor-alkali cell electrolytes, but also in other electrolytes. Thus the metals chosen must be chosen to fit the conditions to which they are going to be exposed. Typically titanium is the preferred metal for the anode compartment liner 26. Other metals suitable for such conditions can usually be found in the following group: titanium, titanium alloys, tantalum, tantalum alloys, niobium, niobium alloys, hafnium, hafnium alloys, zirconium and zirconium alloys.

The number of metals suitable for the cathode side liner 48 is usually much larger than the number suitable for the anode compartment side principally due to the fact that most metals are immune from chemical attack under the relatively high pH conditions present in the catholyte and due to the electrical cathodic protection provided by the metal on the anolyte side of the cell structure 12. Ferrous materials are usually preferred as the metals for the cathode side liner. This includes steel and stainless steel. Other usually suitable liner 48 material includes nickel, chromium, tantalum, cadmium, zirconium, lead, zinc, vanadium, tungsten, iridium, cobalt and alloys of each of these metals.

When a liner metal is used which is weldably incompatible with the metal of the cell structure 12, and when the liner 26 or 48 is to be connected to the cell structure 12 by welding, then metal intermediates are positioned between the cell structure bosses and the metal liner at the location where the welds are to be made. These metal intermediates may be in the form of a single metal wafer, in the form of a multilayered metal coupon, or in the form of a metal film formed either on the cell structure 12 or the liner 26 or 48.

We claim:

1. In a cell structure used in forming a bipolar electrode, filter press, solid polymer electrolyte, electrolytic cell unit, which unit is capable of being combined with other cell units to form a plurality of electrolysis cells;

each of said electrolysis cells having at least one planarly disposed solid polymer electrolyte membrane separating the anode compartment and cathode compartment;

said cell structure having a central barrier which physically separates an anode compartment of an electrolysis cell located on one side of the barrier from a cathode compartment of an adjacent electrolysis cell located on the opposite side of the barrier;

each of said electrolysis cells at least having an anode component and a cathode component, wherein at least one of such components is electrocatalytically active and is embedded in or bonded to the solid polymer electrolyte membrane;

said central barrier electrically connecting the anode component of one side of said structure to the cathode component on the opposite side of said structure;

said anode and cathode compartments having a peripheral structure around their periphery to complete the physical definition of said compartments;

said cell structure also having an electrical current transfer means associated with it for providing electrical current paths through the central barrier from its adjacent cathode compartment to its adjacent anode compartment;

and which cell structure includes anode component and cathode component stand-off means for maintaining the anode component and cathode component of the two electrolysis cells adjacent to the central barrier at a predetermined distances from the central barrier;

the improvement which comprises:

the central barrier, the anode and cathode compartment peripheral structures, the anode component stand-off means, the cathode component stand-off means, and at least part of the electrical current transfer means all being integrally formed into a unitary central cell element made from a single casting of a castable metal; and, further said castable metal being electrically conductive so as to be the part of the electrical current transfer means which transfers electricity through the central barrier from the adjacent cathode compartment to the adjacent anode compartment; and said unitary central cell element being formed in such a fashion so as to provide the structural integrity required to physically support the contents of the adjacent electrolyte compartments as well as to support the associated electrolysis cell appurtenances which are desired to be supported by the unitary central cell element; and said anode component stand-off means and that part of the electrical current connecting means located in the unitary central cell element on the anode side of the central barrier being combined into a multiplicity of anode component bosses projecting a predetermined distance outwardly from the central barrier into the anode compartment adjacent to the central barrier, said anode component bosses being capable of being mechanically and electrically connected either directly or indirectly to the anode component of said anode compartment; and said cathode component stand-off means and that part of the electrical current connecting means located on the cathode side of the central barrier beinig combined into a multiplicity of cathode component bosses projecting a predetermined distance outwardly from the central barrier into the cathode compartment adjacent to the central barrier, siad cathode component bosses being capable of being mechanically and electrically connected either directly or indirectly to the cathode component; and said anode component bosses being spaced apart in a fashion such that fluids can freely circulate throughout the totality of the adjacent anode compartment, and, likewise, said cathode component bosses being spaced apart in a fashion such that fluids can freely circulate throughout the totality of the adjacent cathode compartment;

at least one of said electrode components comprising:

an interconnected, electrically conductive, electrocatalytic material bonded to or embedded in the solid polymer electrolyte membrane; and a hydraulically permeable current collector electrically connected to said electrically conductive material and to said electrode bosses.

2. The improvement of claim 1 wherein the castable metal of the unitary central cell element is selected from the group consisting of: iron, steel, stainless steel, nickel, aluminum, copper, chromium, magnesium, tantalum, cadmium, zirconium, lead, zinc, vanadium, tungsten, iridium, rhodium, cobalt, alloys of each, and alloys thereof.

3. The improvement of claim 1 wherein the metal of the unitary central cell element is selected from the group consisting of ferrous metals.

4. The improvement of claim 1 which further comprises an anode side liner made of a metal sheet fitted over those surfaces on the anode compartment side of the cell structure which would otherwise be exposed to the corrosive environment of the anode compartments;

said anode side liner being an electrically conductive metal which is essentially resistant to corrosion due to the anode compartment environment;

said metal liner being formed so as to fit over and around the anode bosses and said liner being connected to the unitary central cell element at the anode bosses; and said liner being depressed sufficiently around the spaced anode bosses toward the central barrier in the spaces between the bosses so as to allow free circulation of the fluids between the lined unitary central cell element and the solid polymer electrolyte membrane of the adjacent anode compartment, the liner replacing the unitary central cell element surface contacting the anolyte.

5. The improvement of claim 4 wherein the metal liner is connected to the anode bosses by welding through a metal intermediate which is disposed between the bosses and the liner, the metal of the metal intermediate being not only weldable itself, but also being weldably compatible with both the metal of the anode side liner and the metal of which the unitary central cell element is made, that is weldably compatible with both metals to the point of being capable of forming a ductile solid solution with them at welds of them upon their welding.

6. The improvement of claim 4 wherein the unitary cell element is made of a ferrous material and wherein the anode side liner is made of a metallic material selected from the group consisting of titanium, titanium alloys, tantalum, tantalum alloys, niobium, niobium alloys, hafnium, hafnium alloys, zirconium and zirconium alloys.

7. The improvement of claim 6 wherein there are metal coupons situated in an abutting fashion between the anode bosses and the anode side liner, with each coupon having at least two metal layers bonded together and with the outside metal layer of one side of the coupon abutting the anode boss and the outside metal layer of the opposite side of the coupon abutting the anode side liner, the metal layer of the coupons which abuts each anode boss being weldably compatible with the ferrous material of which the anode bosses are made and accordingly being welded to said anode bosses, and the metal layer of that side of the coupons abutting the anode side liner being weldably compatible with the metallic material of which the anolyte side liner is made and accordingly being welded to said liner so that the liner is welded to the anode bosses through the coupons.

8. The improvement of claim 4 wherein the anode side liner is made of titanium or a titanium alloy, and wherein the castable material from which the unitary central cell element is made is a ferrous material.

9. The improvement of claim 8 wherein vanadium wafers are interposed between the anode bosses and the adjacent anode side liner, and the titanium anode side liner is welded to the ferrous material bosses through the vanadium wafers.

10. The improvement of claim 4 wherein the metal intermediates situated between the anode bosses and the adjacent anode side liner are joined to the ends of the anode bosses by a film-forming process.

11. The improvement of claim 4 wherein no metal intermediate is used between the liner and the anode bosses, but wherein the anode side liner is directly bonded to the anode bosses by welding.

12. The improvement of claim 4 wherein no metal intermediate is used, but wherein the anode side liner is bonded directly to the anode bosses by explosion bonding or diffusion bonding.

13. The improvement of claim 4 wherein the anode side metal liner extends over the lateral face of the anode compartment peripheral structure so as to form a sealing face thereat for the solid polymer electrolyte membrane when the cell segments are squeezed together to form a cell series.

14. The improvement of claim 4 wherein the anode side liner is connected to the unitary central cell element at the ends of the anode bosses.

15. The improvement of claim 4 wherein the anode side liner is welded to the ends of the anode bosses through an intermediate metal coupon or wafer.

16. The improvement of claim 1 which further comprises a cathode side liner made of a single metal sheet fitted over those surfaces of the unitary central cell element which would otherwise be exposed to the oathode oompartment of the adjacent electrolysis cell;

said oathode side liner being an electrically conductive metal which is essentially resistant to corrosion due to the cathode compartment environment;

said liner being depressed sufficiently around the spaced cathode bosses toward the central barrier in the spaces between the bosses so as to allow free circulation of the fluids between the lined unitary central cell element and the solid polymer electrolyte membrane of the adjacent cathode compartment, the liner replacing the unitary central cell element surface adjacent to the cathode compartment as one boundary contacting the cathode compartment fluids.

17. The improvement of claim 16 wherein the metal liner is connected to the cathode bosses by welding through a metal intermediate which is disposed between the bosses and the liner, the metal of the metal intermediate being not only weldable itself, but also being weldaby compatible with both the metal of the cathode side liner and the metal of which the unitary cell element is made, that is weldably compatible with both metals to the point of being capable of forming a ductile solid solution with them at the welds upon welding.

18. The improvement of claim 16 wherein the unitary cell element is made of a ferrous material and wherein the cathode side metal liner is selected from the group consisting of ferrous materials, nickel, nicke alloys, chromium, tantalum, cadmium, zirconium, lead, zinc, vanadium, tungsten, iridium, and cobalt.

19. The improvement of claim 16 wherein there are metal coupons situated between the cathode bosses and the cathode side liner, with each coupon having at least two metal layers bonded together, the metal layer of the coupons which abuts each cathode boss being weldably compatible with the ferrous material of which the cathode bosses are made and accordingly being welded to said cathode bosses, and the metal layer of that side of the coupons abutting the catholyte side liner being weldably compatible with the metallic material of which the cathode side liner is made and accordingly being welded to said liner so that the liner is welded to the cathode bosses through the coupons.

20. The improvement of claim 16 wherein the metal of the unitary central cell element, of the cathode side liner, and of the cathode of the adjacent electrolysis cell are all selected from the group consisting of ferrous materials.

21. The improvement of claim 16 wherein the metal intermediates situated between the cathode bosses and the adjacent cathode side liner are joined to the ends of the cathode bosses by a film-forming process.

22. The improvement of claim 16 wherein the metal of said cathode liner is compatible with the direct welding of it to the metal of the unitary central cell element and also directly weldable to the cathode of the cathode compartment;

the metal liner being formed so as to fit over and around the ends of the cathode bosses and welded directly on one side of the liner to the bosses in a manner so to provide an electrical connection between the unitary central cell element and the cathode component which itself is directly welded to the opposite side of the cathode side liner.

23. The improvement of claim 16 wherein the catholyte side metal liner extends over the lateral face of the cathode compartment peripheral structure so as to form a sealing face thereat for the solid polymer electrolyte membrane when the cell segments are squeezed together to form a cell series.

24. A process of electrolyzing sodium chloride brine comprised of passing electricity through a series of electrolysis cells whose cell structures are comprised of adjoining unitary cell elements like those defined in claim 1.

25. The process of claim 24 wherein a cation exchange solid polymer electrolyte membrane is used to separate said anode compartment from said cathode compartment.

26. The process of claim 25 wherein the cation exchange solid polymer electrolyte membrane has sulfonic acid groups as its functional groups.

27. The process of claim 25 wherein the cation exchange solid polymer electrolyte membrane has carboxylic acid groups as its functional groups.

28. The process of claim 25 wherein the cation exchange solid polymer electrolyte membrane comprises a combination of sulfonic acid groups and carboxylic acid groups.

29. The process of claim 25 wherein the cation exchange solid polymer electrolyte membranes are reinforced to impair deforming during electrolysis conditions.

30. The process of claim 25 wherein the cation exchange solid polymer electrolyte membranes are not reinforced to decrease the electrical resistivity of said solid polymer electrolyte membrane.

31. The process of claim 24 wherein the sodium chloride aqueous solution electrolyzed is maintained at a pH of between about 0.5 and about 5.0 during electrolysis.

32. The process of claim 24 wherein the brine solution electrolyzed in the cells contains no more than about 0.08 milligrams per liter of calcium.

33. The process of claim 24 wherein calcium is removed from the brine to a level of concentration of no greater than about 0.08 milligrams per liter prior to the brine being electrolyzed by a multivalent cation removal process which includes passage of the brine through at least one chelating ion exchange resin bed.

34. The process of claim 24 which includes electrolyzing brine which contains carbon dioxide in concentrations no greater than about 70 parts per million as measured just prior to the brine being electrolyzed when the pH of the brine is maintained at a level lower than 3.5 by a process which includes the addition of hydrochloric acid to the brine prior to its being electrolyzed.

35. The process of claim 24 wherein the temperature of the brine is maintained at a level greater than about 80° C.

36. The process of claim 24 which further comprises operating the cell at an electrolyte pressure of less than about seven atmospheres.

37. The process of claim 24 which further comprises operating the electrolysis cell at an electrical current density of from about 0.5 to about 5.0 amperes per square inch of anode surface.

38. The process of claim 24 wherein the electrolysis is carried out while circulating the anolyte through the anode compartment via forced circulation.

39. The process of claim 24 wherein the electrolysis is carried out while circulating the catholyte through the cathode via forced circulation.

40. The process of claim 24 wherein the electrolysis is carried out while circulating both the anolyte and catholyte through their respective compartments via forced circulation.

41. The process of claim 24 wherein the soluble silica is removed from the brine electrolyzed to a level of concentration of no greater than about 4 mg./liter prior to its being electrolyzed.

42. The process of claim 24 wherein iron compounds and other multivalent metals are removed from the brine electrolyzed to a leve of concentration of no greater than about 0.05 mg./liter prior to the electrolysis of the brine in order to increase the life of the solid polymer electrolyte membrane and electrodes.

43. The process of claim 24 wherein the aqueous sodium hydroxide solution is produced with a sodium chloride content of no more than 350 ppm based on 100% sodium hydroxide.

44. The process of claim 24 wherein sulfate is removed from the brine electrolyzed to a level of concentration of no greater than about 5.0 g./liter prior to the electrolysis of the brine.

45. The process of claim 24 wherein the electrolysis is carried out while circulating the catholyte through the cathode compartment via a gas lift method.

46. The process of claim 24 wherein the electrolysis is carried out while circulating the anolyte through the anode compartment via a gas lift method.

47. The improvement of claim 1 wherein the electrode component comprising the interconnected, electrically conductive, electrocatalytic material bonded to or embedded into the ion exchange solid polymer electrolyte membrane and having the hydraulically permeable current collector electrically connected to the interconnected, electrically conductive, electrocatalytic material and to the electrode bosses is the cathode.

48. The improvement of claim 1 wherein the electrode component comprising the interconnected, electrically conductive, electrocatalytic material bonded to or embedded into the ion exchange solid polymer electrolyte membrane and having the hydraulically permeable current collector electrically connected to interconnected, electrically conductive, electrocatalytic material and to the electrode bosses is the anode.

49. The improvement of claim 1 wherein a resilient, electrically conductive structure is interposed between the hydraulically permeable current collector and the solid polymer electrode.

50. The improvement of claim 1 wherein a resilient, electrically conductive structure is interposed between the hydraulically permeable current collector and the solid polymer electrolyte and a second hydraulically permeable current collector is interposed between the resilient structure and the solid polymer electrolyte.

* * * * *

UNITED STATES PATENT AND TRADEMARK OFFICE

CERTIFICATE OF CORRECTION

PATENT NO. : 4,604,171

DATED : August 5, 1986

INVENTOR(S) : Gregory J.E. Morris, John R. Pimlott, Richard N. Beaver, Hiep D. Dang and Sandor Grosshandler It is certified that error appears in the above-identified patent and that said Letters Patent is hereby corrected as shown below:

In the "Abstract", line 2; change "pass" to --press--.

Col. 1, line 63; change "fdr" to --for--.

Col. 4, line 47; change "conuections" to --connections--.

Col. 4, line 52; change "capabiity" to --capability--.

Col. 6, line 57; change "materias" to --materials--.

Col. 7, line 28; change "adJa-" to --adja- --.

Col. 7, line 63; change "directy" to --directly--.

Col. 8, line 45; change "exampe," to --example,--.

Col. 9, line 66; change "lhe" to --the--.

Col. 11, line 28; change "oathode" to --cathode--.

Col. 12, line 66; change "case" to --cast--.

UNITED STATES PATENT AND TRADEMARK OFFICE

CERTIFICATE OF CORRECTION

PATENT NO. : 4,604,171

DATED : August 5, 1986

INVENTOR(S) : Gregory J.E. Morris, John R. Pimlott, Richard N. Beaver, Hiep D. Dang and Sandor Grosshandler It is certified that error appears in the above-identified patent and that said Letters Patent is hereby corrected as shown below:

Col. 14, line 49; change "cels" to --cells--.

Col. 15, line 33; change "ower" to --lower--.

Col. 17, line 62; change "oell" to --cell--.

Col. 18, line 29; change "electroyte" to --electrolyte--.

Col. 18, line 31; change "uniformy" to --uniformly--.

Col. 20, line 19, Claim 1; change "beining" to --being--.

Col. 20, line 23, Claim 1; change "siad" to --said--.

Col. 21, line 2, Claim 4; insert --adjacent to the anode compartment as one boundary-- between "surface" and "contacting".

Col. 22, line 7, Claim 16; change "oa-" to --ca- --.

Col. 22, line 8, Claim 16; change "oompartment" to --compartment--.

Col. 22, line 9, Claim 16; change "oathode" to --cathode--.

UNITED STATES PATENT AND TRADEMARK OFFICE

CERTIFICATE OF CORRECTION

PATENT NO. : 4,604,171

DATED : August 5, 1986

INVENTOR(S) : Gregory J.E. Morris, John R. Pimlott, Richard N. Beaver, Hiep D. Dang and Sandor Grosshandler It is certified that error appears in the above-identified patent and that said Letters Patent is hereby corrected as shown below:

Col. 22, line 27, Claim 17; change "daby" to --dably--.

Col. 22, line 35, Claim 18; change "nicke" to --nickel--.

Col. 23, line 42, Claim 32; change "milligrams" to --milligram--.

Col. 23, line 45, Claim 33; change "milligrams" to --milligram--.

Col. 24, line 19, Claim 42; change "leve" to --level--.

Signed and Sealed this

Eighth Day of September, 1987

*Attest:*

*Attesting Officer*

DONALD J. QUIGG

*Commissioner of Patents and Trademarks*